US005175948A

United States Patent [19]

Tonel et al.

[11] Patent Number: 5,175,948

[45] Date of Patent: Jan. 5, 1993

[54] REAR SUPPORT ADJUSTMENT DEVICE, PARTICULARLY FOR SKI BOOTS

[75] Inventors: Valerio Tonel, Biadene; Mario Gonella, Conegliano; Maurizio Tacchetto, Noventa Padovana, all of Italy

[73] Assignee: Nordica S.p.a., Montebelluna, Italy

[21] Appl. No.: 720,139

[22] Filed: Jun. 24, 1991

[30] Foreign Application Priority Data

Jul. 6, 1990 [IT] Italy ..... 59364/90[U]
Jul. 6, 1990 [IT] Italy ..... 59365/90[U]
Jul. 6, 1990 [IT] Italy ..... 59366/90[U]

[51] Int. Cl.[5] ..... A43B 5/04
[52] U.S. Cl. ..... 36/117; 36/121
[58] Field of Search ..... 36/117, 118, 119, 120, 36/121

[56] References Cited

U.S. PATENT DOCUMENTS 3,303,584 2/1967 Werner et al. ..... 36/120
3,729,842 5/1973 Stelzer ..... 36/120
3,988,842 11/1976 Rathmell ..... 36/117
4,455,768 6/1984 Salomon .
4,561,196 12/1985 Petrini et al. ..... 36/118
4,685,225 8/1987 Hensler .
4,809,448 3/1989 Tonel et al. ..... 36/121
4,864,745 9/1989 Hensler .
4,888,889 12/1989 Sartor ..... 36/117
4,962,595 10/1990 Perner .
5,054,215 10/1991 Tonel et al. ..... 36/120
5,062,224 11/1991 Taccheto ..... 36/117

FOREIGN PATENT DOCUMENTS 317764 5/1989 European Pat. Off. .
342463 11/1989 European Pat. Off. .

*Primary Examiner*—Paul T. Sewell
*Assistant Examiner*—M. D. Patterson
*Attorney, Agent, or Firm*—Guido Modiano; Albert Josif

[57] ABSTRACT

A support adjustment device for ski boots composed of a shell with which at least one quarter is associated. The peculiarity of the device consists of the fact that a shaped body is elastically associated with the quarter and embraces at least one portion of the skier's leg. The device furthermore includes sliders suitable for limiting the backward stroke of the shaped body with respect to the quarter. A safe and constant support of the calf is thus obtained.

3 Claims, 5 Drawing Sheets

REAR SUPPORT ADJUSTMENT DEVICE, PARTICULARLY FOR SKI BOOTS

BACKGROUND OF THE INVENTION

The present invention relates to a rear support adjustment device particularly usable in ski boots.

The problem of achieving optimum support for the skier's calf once the boot has been put on, is currently felt.

U.S. Pat., No. 3,729,841, in fact discloses a ski boot having an upper quarter which is transversely articulated at a recess defined at the rear end of the boot.

Said upper quarter can rotate only about its axis, thus following the inclination of the skier's leg.

The disadvantage of this solution consists of the fact that the upper quarter is a rigid supporting element for the leg during the extension step, and thus once the maximum angle of rotation is attained it cannot cushion impacts on the calf in any way.

A similar disadvantage is observed in U.S. Pat. No. 3,945,135, which describes a ski boot having a vertical bar to which an upper quarter is transversely and rotatably articulated.

A U.S. Pat. No. 4,030,214 is also known, disclosing a boot which comprises a semi-rigid shell which is provided, in a rearward position, with a vertical notch to the side of which openings are defined for the insertion of a slider which is adapted to limit the deformation of the flaps of said notch.

A more or-less rigid rear support is obtained according to the position of the slider.

The disadvantage of these solutions consists of the fact that when the flaps are opened the supporting action on the calf is lacking from the upper edge of the quarter up to the position of the slider.

Safe support is furthermore not always provided, due to the friction which occurs between the inner shoe and the flaps, which causes a closing return thereof which is not always correct.

Similar remarks can be made for U.S. Pat. No. 4,073,073, which describes a device by means of which the user can use the leg while walking by opening the upper and rear part of the quarter.

This solution is obtained by means of the combination of a central slot, which is obtained from the upper part of the quarter and the enlarged edges of which act as guide for a slider composed of two parts, with a plate arranged inside the quarter and with an eccentric element for the loosening and tightening of said slider.

French patent, no. 2,358,119, is also known which describes a ski boot the rear quarter whereof is divided into three elements which are mutually partially movable by virtue of the presence of a notch defined transversely to said rear quarter.

This solution has disadvantages, since it can be used only for a forward flexing of the quarter, whereas for a backward flexing it allows no optimum support of the calf, since the individual elements can in practice slide only forward with respect to one another.

Each element, in fact, has a step-like discontinuity which abuts on a further underlying step-like discontinuity.

However, this also entails difficulties in execution, since during molding there are many undercuts which complicate extraction from the mold.

It is furthermore observed that during forward flexing it is possible to have a deformation of the material (splaying of the openings) which can lead to the formation of yield lines which, besides damaging the quarter, hinder its overall aesthetic appearance.

SUMMARY OF THE INVENTION

The aim of the present invention is therefore to eliminate the disadvantages described above in known types by providing a device which allows the safe and constant support of the skier's calf; the device being capable of cushioning the impact on the calf during the extension step.

Within the scope of the above aim, another important object is to provide a device wherein said support is free from friction which limits the correct support of the calf.

Another important object is to provide a device which allows to preset the degree of support which can be obtained for the skier's calf.

Another object is to provide a device which associates with the preceding characteristics that of being structurally simple as well as rapid and easy to industrialize.

Not least object is to provide a device which is reliable and safe in use.

This aim, these objects and others which will become apparent hereinafter are achieved by a rear support adjustment device, particularly for ski boots composed of at least one quarter associated with a shell, characterized in that a shaped body is elastically associated with said at least one quarter, said body embracing at least one portion of the skier's leg, said device having means adapted to limit the backward stroke of said shaped body with respect to said at least one quarter, said means being provided at an opening, said opening being defined between said quarter and said shaped body.

BRIEF DESCRIPTION OF THE DRAWINGS

Further characteristics and advantages of the invention will become apparent from the detailed description of a particular embodiment, illustrated only by way of non-limitative example in the accompanying drawings, wherein.

DESCRIPTION OF THE PREFERRED EMBODIMENTS

Figure 1:
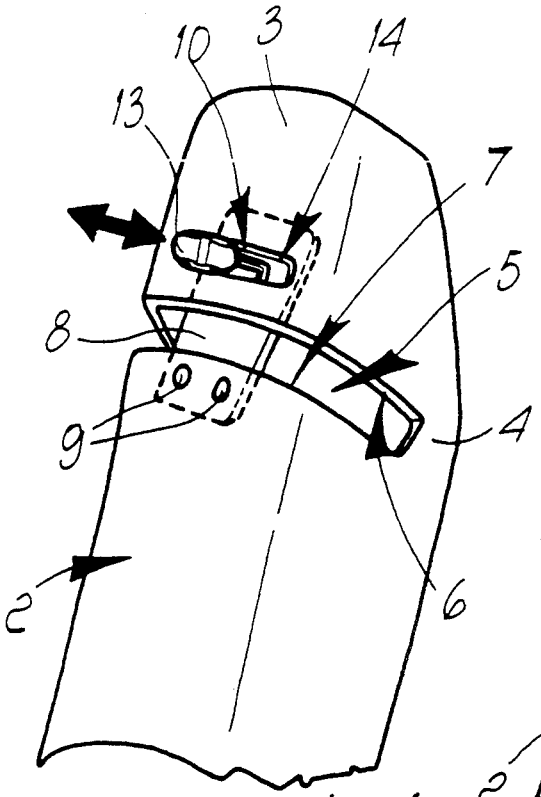
FIG. 1 is a rear isometric partial view of a ski boot according to the invention.
Figure 3:
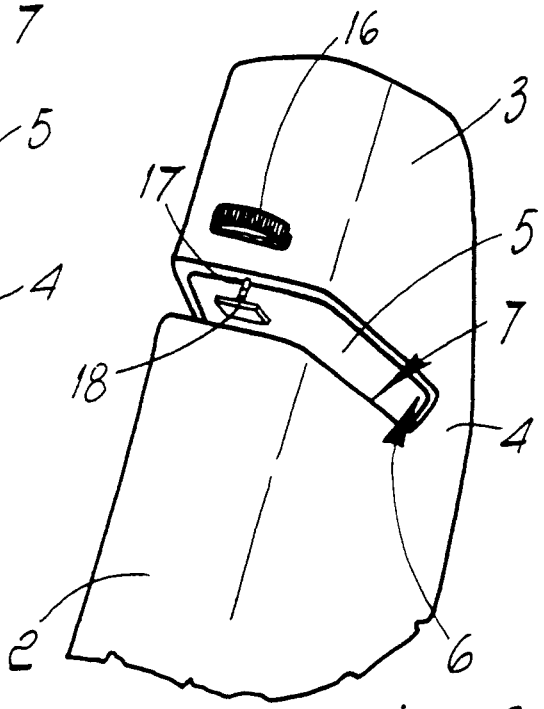
FIG. 3 is a view, similar to that of FIG. 1, of a ski boot according to a further aspect of the invention.
Figure 2:
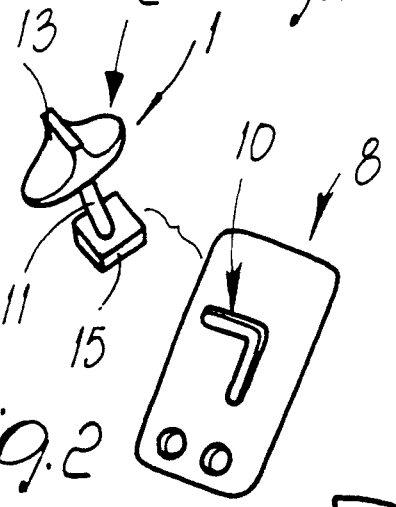
FIG. 2 is a detail exploded view of the plate and slider of the ski boot of the preceding FIGURE.
Figure 4:
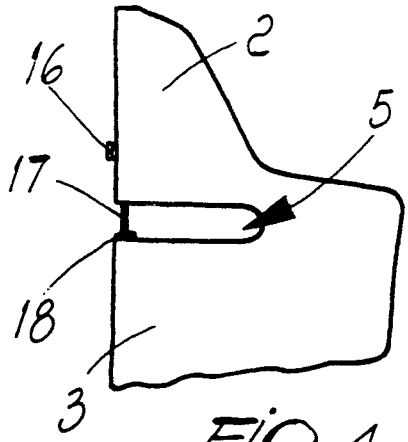
FIGS. 4 and 5 are schematic side partial views of a ski boot according to the invention showing two different positions of the shaped body.
Figure 5:
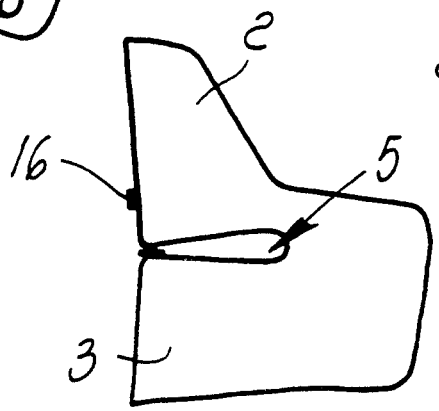

With reference to FIGS. 1-5, the rear support adjustment device, generally indicated by the reference numeral 1, can be used particularly in a ski boot composed of a shell with which at least one quarter, which in the illustrated embodiment is constituted by a rear quarter 2, is associated.

At least one shaped body 3 is elastically associated with the rear quarter 2 and embraces at least one portion of the skier's leg.

The shaped body 3 furthermore has an arc-like configuration which is approximately equal to that of the underlying rear quarter 2 and blends therewith by means of a pair of lateral bridges 4 protruding toward the rear quarter.

A region slotted 5 is thus defined which affects the central part of the rear quarter and partially affects the lateral part thereof, at which a lowering of the lower perimetric edge 6 of the shaped body 3 toward the upper perimetric edge 7 of the rear quarter 2 is allowed.

Means suitable for adjusting the backward stroke of the shaped body 3 with respect to the rear quarter 2 by limiting it are present at the region 5; said means are constituted by a plate 8 which is rigidly associated at one end at the inner lateral surface of the rear quarter 2, preferably by means of one or more adapted rivets 9 which are applied proximate to the region 5.

The plate 8 can also be obtained by molding enbloc with the rear quarter.

A slot 10 is defined at the other end of the plate 8, which is arranged adjacent to the inner lateral surface of the shaped body 3, and has an L-shaped configuration with one wing directed toward the underlying upper perimetric edge 7 of the rear quarter 2.

The stem 11 of a slider 12 can be slidingly arranged at the slot 10; a head 13, which can be accessed by the skier through an opening 14 defined in the shaped body, and an abutment 15 are provided at the ends of the stem 11 in order to allow interaction between said stem, said plate and said shaped body.

The operation of the device is as follows: once the slider 12 is arranged with the stem 11 on the wing of the slot 10 which is directed toward the underlying upper perimetric edge 7 of the rear quarter 2, the shaped body can freely oscillate backward with respect to the underlying rear quarter 2 during the extension step, cushioning the impact of the calf by virtue of the elastic deformation of the bridges.

By arranging the stem 11 at the other wing of the slot 10, a rigid support of the shaped body is achieved.

It has thus been observed that the invention has achieved the intended aim and objects, a device having been obtained which allows a safe and constant support of the skier's calf, the obtainable degree of support being at the same time presettable.

The device is furthermore structurally simple as well as rapid and easy to industrialize.

Alternatively, the means suitable for adjusting the backward stroke of the shaped body 3 with respect to the rear quarter 2 by limiting it, are constituted by a knob 16 which is rotatably associated with the shaped body 3 proximate to the region 5 and actuates a threaded pivot 17 which protrudes from the lower perimetric edge 6 of the shaped body 3 and at the free end of which a base 18 is rigidly associated; said base abuts or not with the underlying upper perimetric edge 7 of the rear quarter 2.

In this case it is also possible to achieve intermediate conditions as regards the degree of support.

With reference to FIGS. 6-15, the rear support adjustment device, generally indicated by the reference numeral 201, can be used particularly in a ski boot composed of a shell with which at least one quarter, which in the illustrated embodiment is constituted by a rear quarter 202, is associated.

At least one shaped body 203 is associated with the rear quarter 202 and embraces at least one portion of the skier's leg.

The association between the rear quarter and the shaped body can be achieved since said shaped body is provided, laterally and downward, with a pair of lateral bridges 204 which protrude toward the underlying rear quarter and blend therewith; said shaped body can thus be obtained together with the rear quarter during molding.

Figures 6, 7, 8, 9:
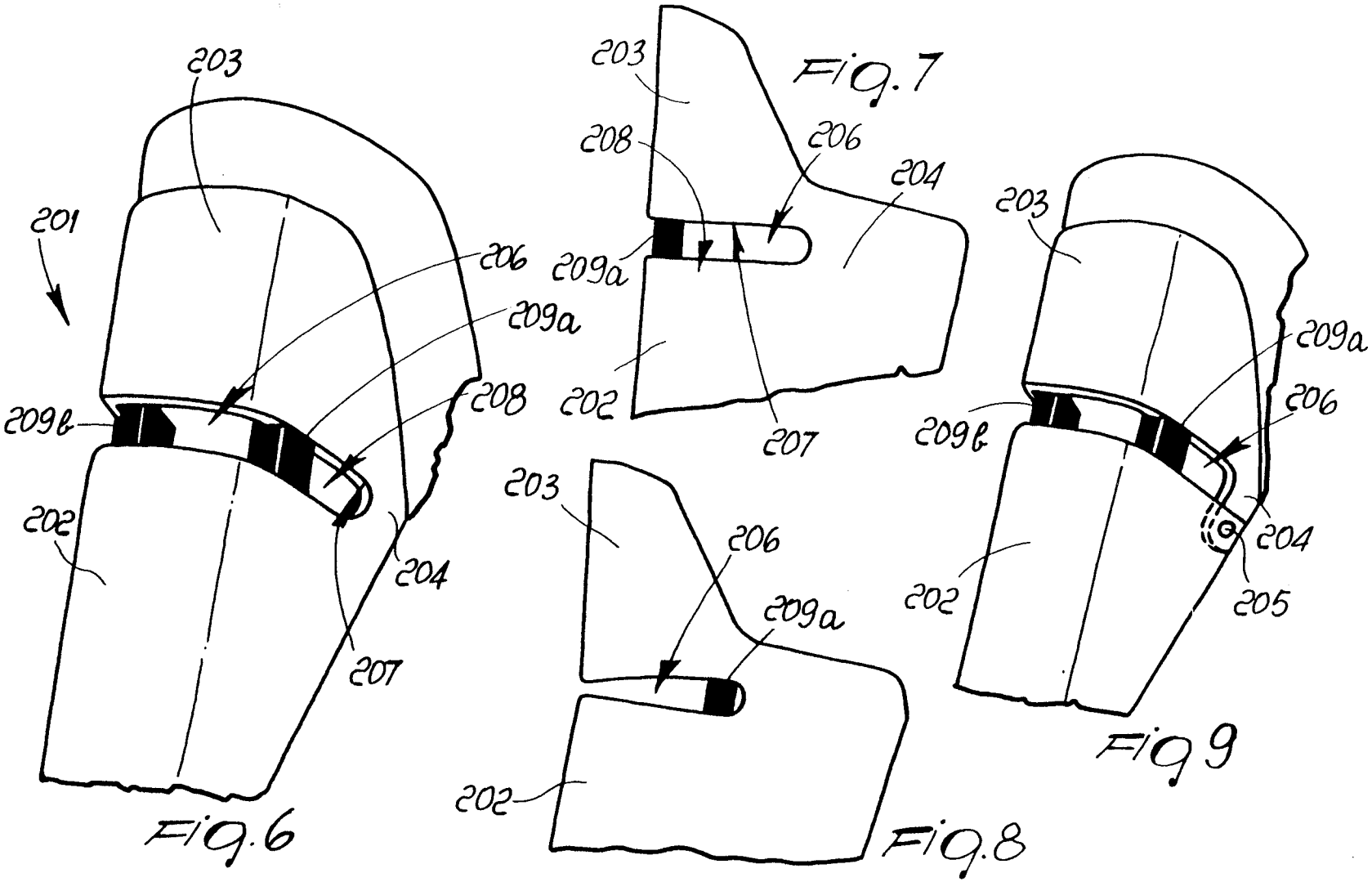
FIG. 6 is a rear isometric partial view of a ski boot according to a third aspect Of the invention.
FIG. 7 and 8 are side partial views of the boot of FIG. 6 respectively in the minimum stroke position and maximum stroke position.
FIG. 9 is a view similar to FIG. 6 of a ski boot according to a fourth aspect of the invention.

Alternatively, the pair of lateral bridges 204 can be transversely pivoted to the underlying rear quarter 202 by using adapted rivets or studs 205, as illustrated in FIG. 9.

The pair of bridges can naturally be arranged at the inner lateral surface of the rear quarter or at the outer one.

The shaped body 203 has an arc-like configuration which is approximately equal to that of the underlying rear quarter 202.

The presence of the pair of lateral bridges which protrude below the shaped body 203 defines a slot 206 which affects the central part of the rear quarter and partially affects the lateral part thereof and at which a lowering of the lower perimetric edge 207 of the shaped body 203 toward the upper perimetric edge 208 of the rear quarter 202 is allowed.

Means suitable for adjusting the backward stroke of the shaped body 203 with respect to the rear quarter 202 by limiting it are present at the slot 206; said means are constituted by one or more sliders which in the particular embodiment are two and are indicated by the numerals **209*a* and 209*b***.

Said one or more sliders, which are rigid or elastically deformable, are slidingly interposed between the lower perimetric edge 207 of the shaped body 203 and the upper perimetric edge 208 of the rear quarter 202.

The operation of the device is as follows: by arranging the sliders **209*a* and 209*b* in the desired portion of the slot 206, the skier can present the elastic response of the support, as shown in FIGS. 7 and 8**.

The shaped body can thus oscillate backward while skiing, allowing to achieve a soft or rigid rear support of the calf, and this increases the skier's comfort; the backward stroke of the shaped body can furthermore be adjusted according to the specific configuration of the calf, to the particular conditions of the snow and to the type of skiing.

It is thus possible to achieve various adjustments, gradually ranging from the rigid support of the shaped body, with the sliders arranged proximate or at the central rear region of the slot 206, to the maximum backward oscillation of the shaped body.

Alternatively, the means suitable for adjusting the backward stroke of the shaped body 203 with respect to the rear quarter 202 by limiting it, comprise an elastically deformable band 210 which is associable with the rear quarter and embraces it at least partially proximate to its upper perimetric edge.

Advantageously, said band 210 is rigidly associated with the rear quarter, by means of the rivets or studs 205, both at the lateral ends and at the median region.

The sliders 209*a* and 209*b* are interposed, in this case, between the lower perimetric edge 207 of the shaped body 203 and the upper edge 211 of the band 210; said band is elastically deformed by the sliders during backward support.

Figure 12:
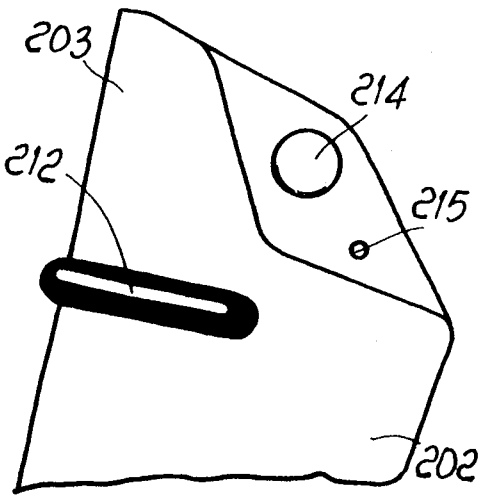
FIGS. 12 and 13 are side partial views of the ski boot of FIG. 11 respectively in the minimum and maximum stroke positions.
Figure 13:
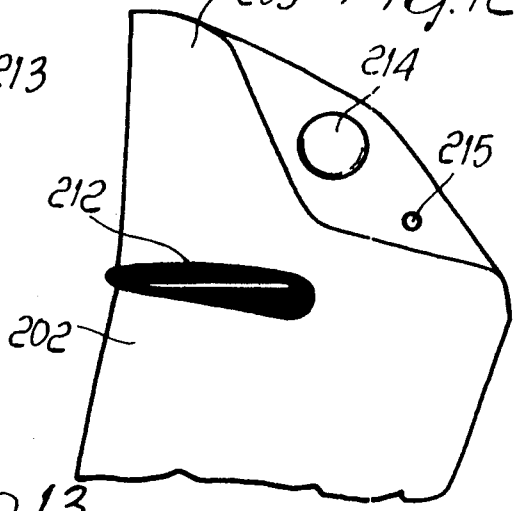
Figure 11:
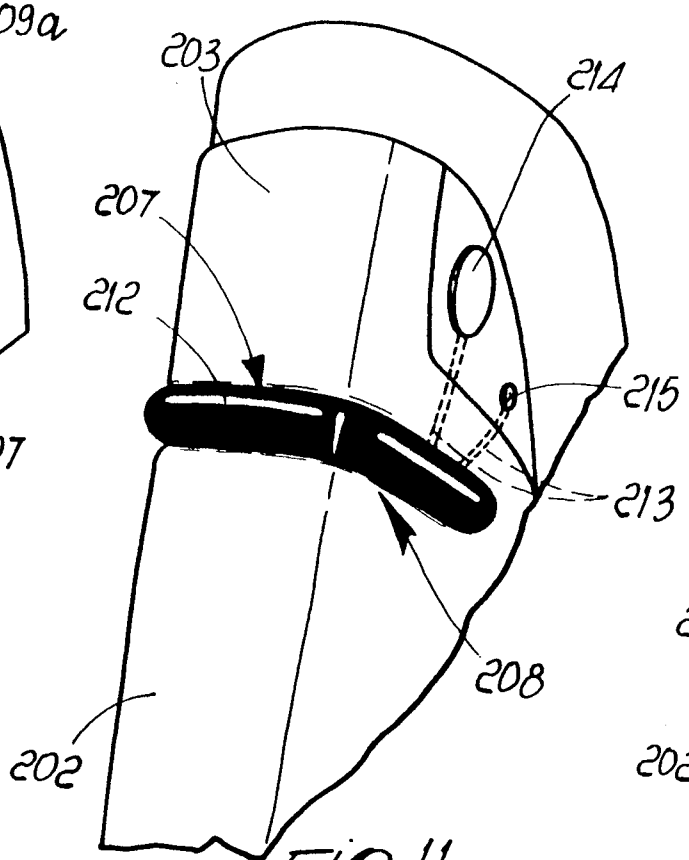
FIG. 11 is a view similar to the preceding one of a ski boot according to a sixth aspect of the invention.
Figure 10:
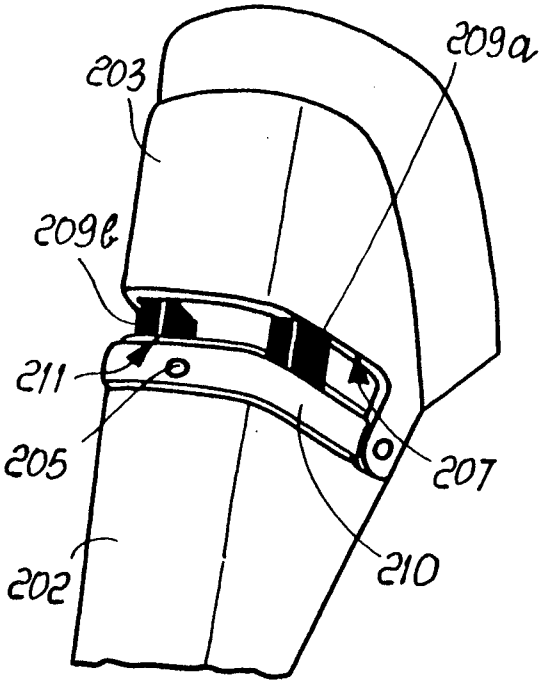
FIG. 10 is a view similar to the preceding one of a ski boot according to a fifth aspect of the invention.

FIGS. 11–13 illustrate a solution wherein the means which allow to adjust the backward stroke of the shaped body 203 with respect to the rear quarter 202 by limiting it, are constituted by a pad or air bag 212 which is interposed between the lower perimetric edge 207 of the shaped body 203 and the upper perimetric edge 208 of the rear quarter 202.

Said pad or air bag 212 has one or more ducts 213 for interconnecting it with a pump 214 and to a vent valve 215 which are associated, laterally or rearward, with the rear quarter 202 or with the shaped body 203.

A more or less soft support of the calf is obtained according to the amount of air fed into the pad or air bag 212.

Figure 15:
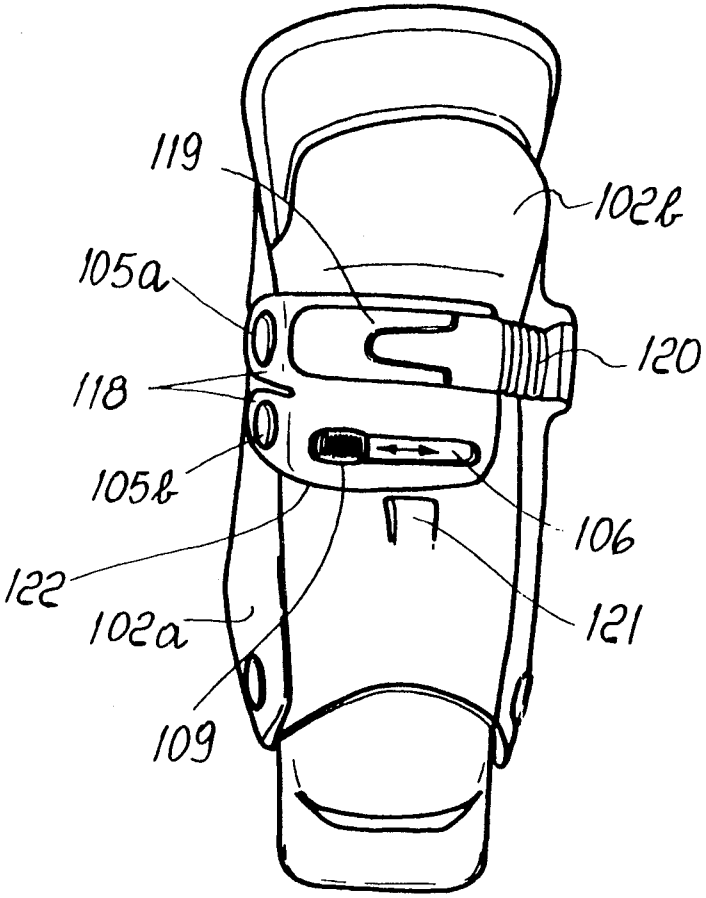
FIGS. 14 and 15 are respectively side and rear isometric views of a ski boot according to a seventh aspect of the invention.
Figure 14:
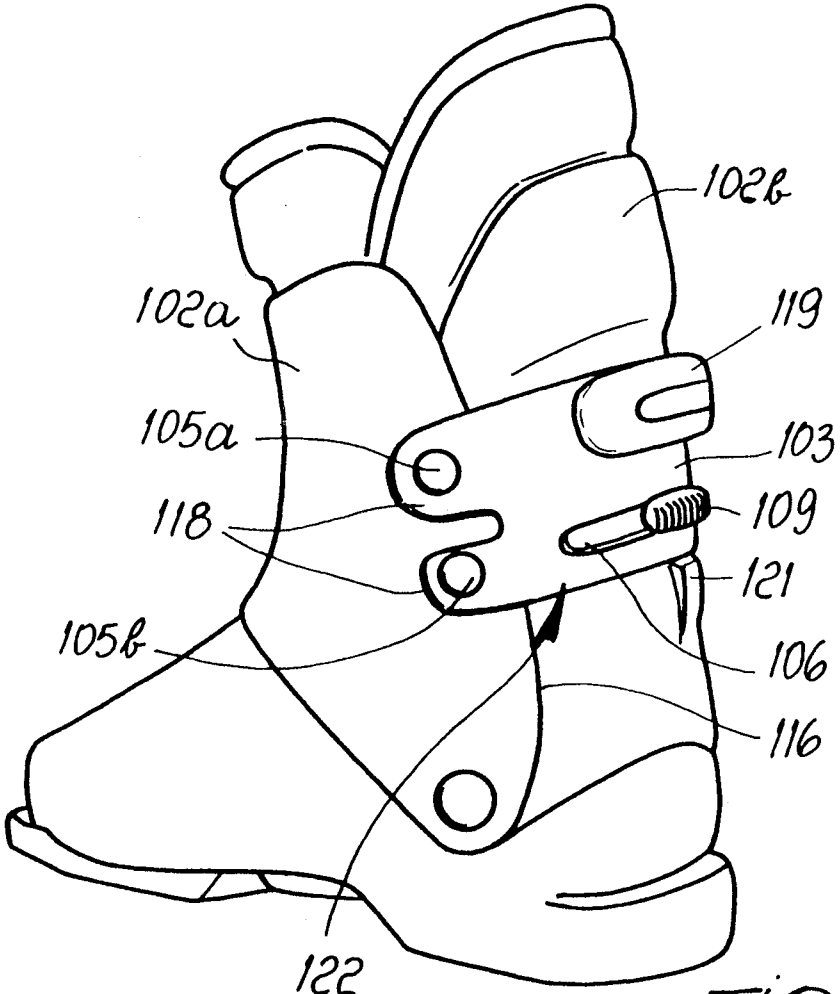

A further embodiment is illustrated in FIGS. 14 and 15, which show a ski boot which comprises a shell with which a front quarter 102*a* and a rear quarter 102*b* are associated A shaped body 103 is associated, proximate to a perimetric edge 116, laterally to the front quarter 102*a* and partially transversely embraces the rear region of the rear quarter 102*b*.

Said shaped body 103 has a pair of wings 118 which protrude beyond said perimetric edge 116 and are associated with the rear quarter 102*b* by means of an adapted pair of studs 105*a* and 105*b*.

A lever 119 for the engagement and tensing of the end of a toothed band 120 is articulated to the shaped body 103 on the side opposite to the wings 118; said toothed band is associable, at its other end, laterally to the front quarter 102*a*.

A slot 106 is defined below the lever 119 transversely to the shaped body 103 and acts as seat for a slider 109 which is slidingly associated thereat.

A lug 121 furthermore protrudes from the rear quarter 102*b* centrally below the shaped body 103 and abuts against the lower perimetric edge 122 of said shaped body.

This embodiment also allows to achieve the intended aim and objects, since it allows to obtain two adjustment positions: one by arranging the slider 109 at the underlying lug 121 and the other by arranging said slider laterally to said lug.

Maximum rigidity is achieved in the first case: in the second case it is possible to achieve a different degree of softness as the distance of the slider from the axis of the lug varies.

Figure 16:
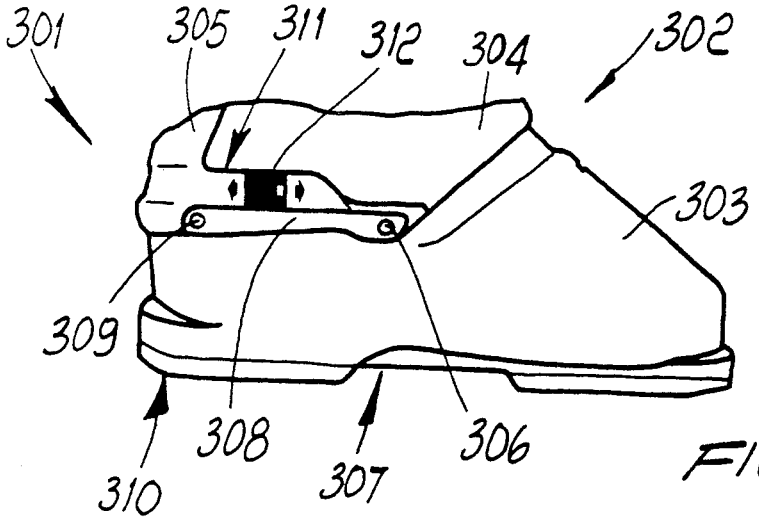
FIG. 16 is a side partial view of a ski boot according to an eight aspect of the invention, shown in the inactive position.
Figure 17:
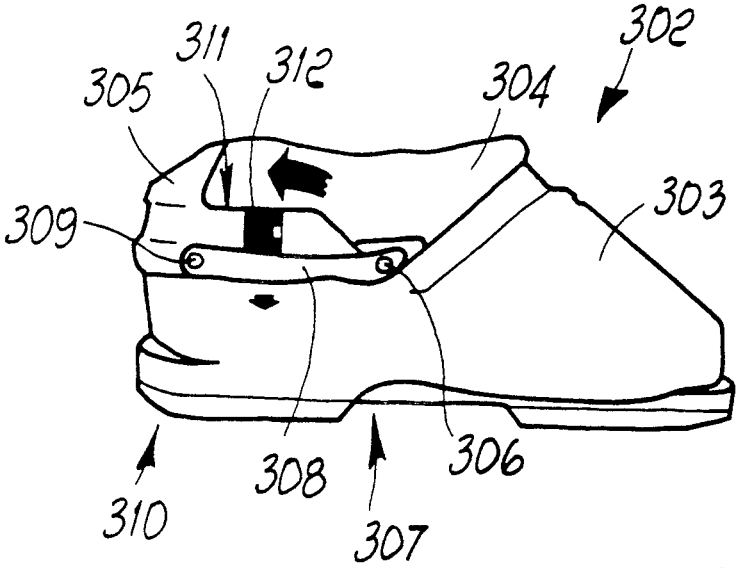
FIG. 17 is a view similar to the preceding one showing the boot in the active position.
Figure 18:
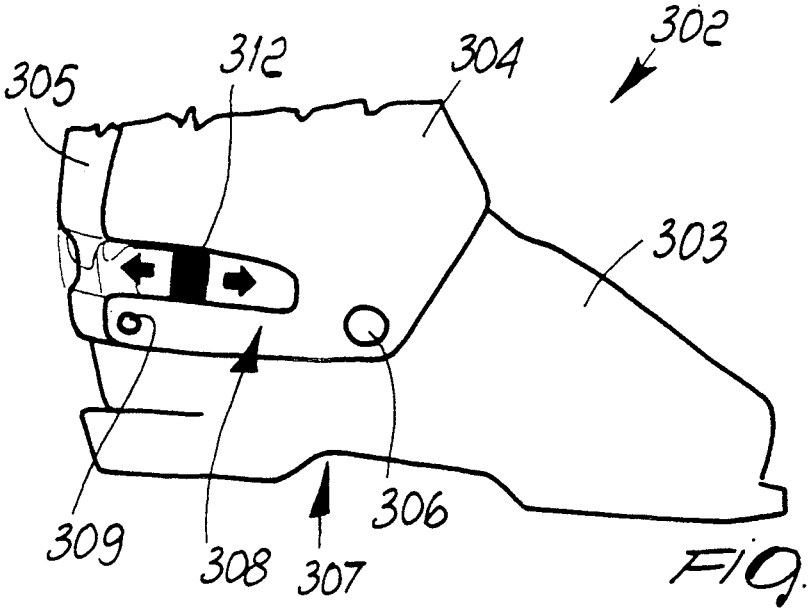
FIG. 18 is a side partial view of a ski boot according to a ninth aspect of the invention.

With reference to FIGS. 16–18, the rear support adjustment device structure, generally indicated by the reference numeral 301, can be used particularly in a ski boot 302 composed of a shell 303 with which a front quarter 304 and a rear quarter 305 are associated.

The front quarter 304 is pivoted to the shell 303 by means of a first pair of studs or rivets 306 in a region 307 preferably approximately at the malleolar region.

At least one elastically deformable band 308 is associated below and laterally to the front quarter 304, and at least one end of said band is rigidly associated with a supporting point which is fixed to the boot, such as the shell 303 or the rear quarter 305.

Specifically, one of the ends of the band 308 is pivoted to the shell at the first pair of studs or rivets 306 and the other end is pivoted at a second pair of studs or rivets 309 arranged above the heel region 310 of the boot 302.

Advantageously, said band 308 is arranged along a horizontal axis which is thus parallel to the ground resting axis of the boot 302.

It should be noted that the band 308 can be applied to the boot, as illustrated in FIGS. 16 and 17, and can at the same time be obtained monolithically with said front quarter 304, as illustrated in FIG. 18.

One or more sliders 312, which can be gripped by the skier, are slidingly interposable between the lower lateral perimetric edge 311 of the front quarter 304 and the underlying band 308.

Said one or more sliders can in turn be rigid or elastically deformable.

The operation of the device is as follows: by positioning, on each side of the boot 302, the sliders 312 in the required section of the band 308, it is possible to achieve, by virtue of the elastic deformation of said band and/or of said sliders, a more or less cushioned rear support for the calf, thus increasing the skier's comfort The backward stroke of the rear quarter can thus be adjusted according to the specific configuration of the calf, to the particular conditions of the snow and according to the type of-skiing performed.

It is thus possible to achieve various adjustments gradually ranging from rigid support, with the sliders arranged proximate to or at the second stud or rivet 309, up to maximum backward oscillation, with the sliders arranged proximate to the first stud or rivet 306.

It has thus been observed that the invention has achieved the intended aim and objects, a device having been obtained which allows to achieve a safe and constant support of the skier's calf, at the same time the obtainable degree of support being presettable.

The device according to the invention is furthermore structurally simple as well as rapid and easy to industrialize.

The materials and the dimensions which constitute the individual components of the structure may naturally be the most appropriate according to the specific requirements.

We claim:

1. The combination of a rear support adjustment device and a rear quarter, particularly of a ski boot comprising a shell and said rear quarter which is connected to said shell and which as a longitudinal extension extending upwardly from said shell, said rear support adjustment device comprising a shaped body for embracing a rear portion of a user's lower leg, said shaped body being arranged at a top end of said rear quarter, said shaped body having an arc-shaped configuration and being connected with said upper end of said rear quarter by means of a pair of elastic lateral bridges which blend said shaped body with said upper end of said rear quarter, said upper end of said rear quarter having an upper perimetric edge and said shaped body having a lower perimetric edge, a slotted region being defined between said upper perimetric edge of said rear quarter and said lower perimetric edge of said shaped body, said slotted region extending substantially transversely to said longitudinal extension of said rear quarter between said pair of elastic lateral bridges and said shaped body being able to pivot rearwardly with respect to said rear quarter with a lowering movement of said lower perimetric edge of said shaped body toward said upper perimetric edge of said upper end of said rear quarter, said rear support adjustment device further comprising: a plate element which is rigidly connected to said upper end of said rear quarter and which extends upwardly to said shaped body; an L-shaped slot which is provided in one of said shaped body and said plate element and which has a first wing extending substantially parallel to said longitudinal extension of said rear quarter and a second wing extending substantially perpendicularly to said longitudinal extension of said rear quarter; a slotted opening which is provided on the other one of said shaped body and said plate element to which said L-shaped slot is provided and which extends in a direction substantially perpendicular to said longitudinal extension of said rear quarter, said slotted opening being arranged over said second wing of said L-shaped slot and also above a point where said first and second wings intersect; and a slider element comprising a stem which extends through both of said L-shaped slot and said slotted opening, said stem being slidably positionable in said L-shaped slot and said slotted opening thereby when said stem is positioned in said second wing of said L-shaped slot a blocking action of the pivotal movement of said shaped body is obtained while when said stem is positioned in said first wing of said L-shaped slot said shaped body is free to elastically and rearwardly pivot with respect to said rear quarter.

2. The combination of claim 1, wherein said L-shaped slot is provided in said plate element and said transverse slot is provided in said shaped body.

3. The combination of claim 1, wherein said slider element further comprises a head and an abutment connected at opposite ends of said stem, said head being arranged at an outer surface of the ski boot so as to be accessible by a user.

* * * * *